United States Patent [19]

Uchitelle

[11] Patent Number: 4,559,652

[45] Date of Patent: Dec. 24, 1985

[54] SELF-OPENING PORTABLE SWIMMING ENCLOSURE AND METHOD OF USING SAME

[76] Inventor: Benjamin Uchitelle, 41 Crestwood Dr., Clayton, Mo. 63105

[21] Appl. No.: 521,009

[22] Filed: Aug. 8, 1983

[51] Int. Cl.[4] ..... A47K 3/00; E04H 3/18

[52] U.S. Cl. ..... 4/487; 4/506

[58] Field of Search ..... 4/487, 506, 661, 505, 4/513–514

[56] References Cited

U.S. PATENT DOCUMENTS 2,092,782 9/1937 Serafinowicz ..... 4/487

3,456,265 7/1969 Carnahan ..... 4/487

3,571,819 11/1969 Puncochar ..... 4/487

4,100,746 7/1978 Preus ..... 4/487

*Primary Examiner*—Henry K. Artis

*Attorney, Agent, or Firm*—Gravely, Lieder & Woodruff

[57] ABSTRACT

This disclosure concerns a self-opening portable swimming enclosure which can be coiled into a compact shape for storage and which, when placed in the water without restraint, will open by itself into a circular shape with a protective netting suspended from floats which provide an upstanding lip above the water surface around the periphery of the enclosure.

9 Claims, 6 Drawing Figures

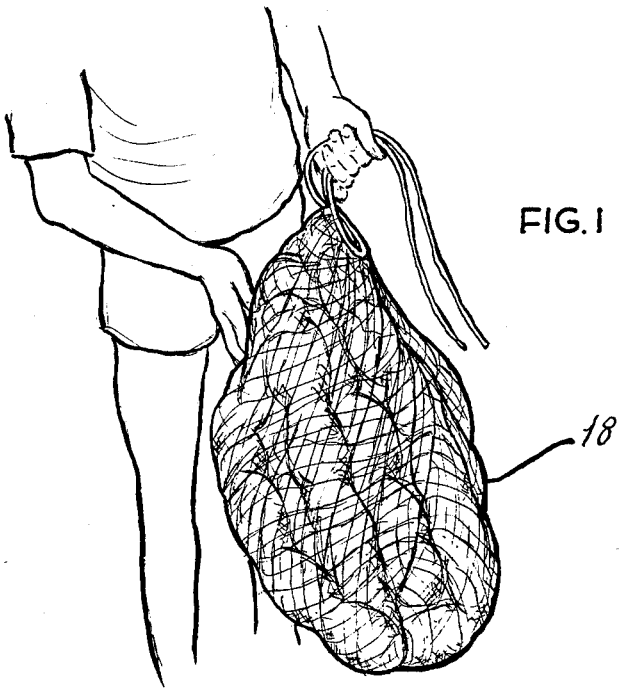
FIG. 1
FIG. 2
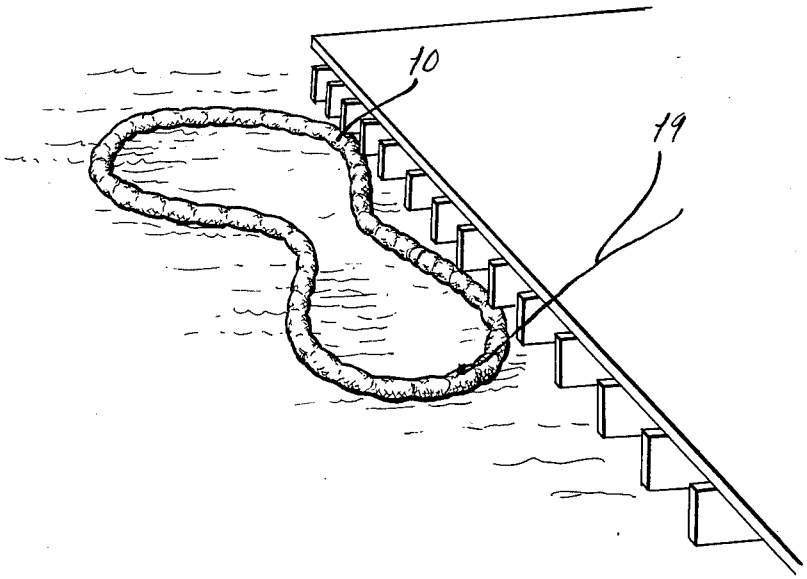

FIG. 3
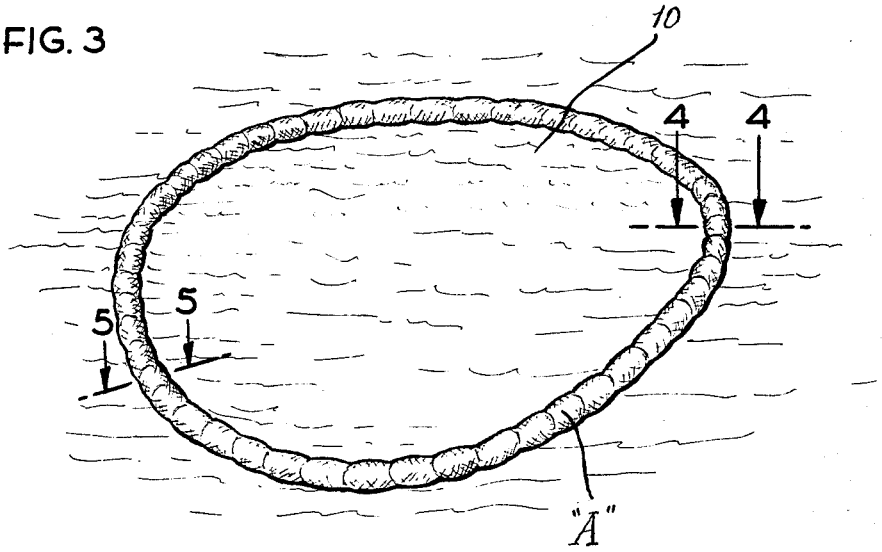
FIG. 4
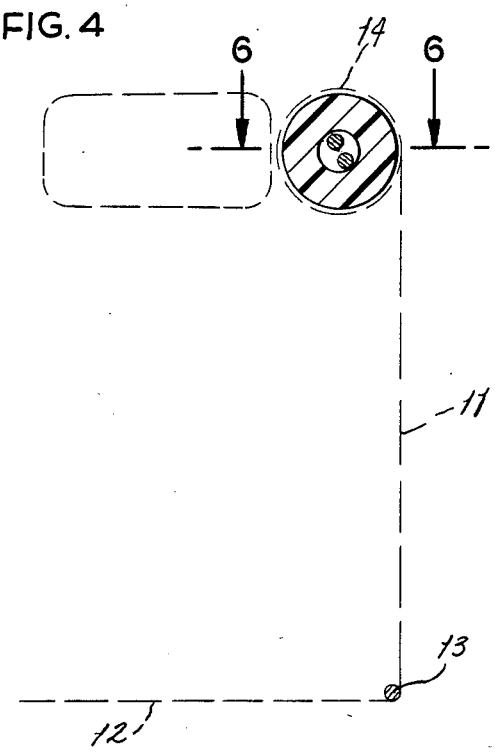
FIG. 5
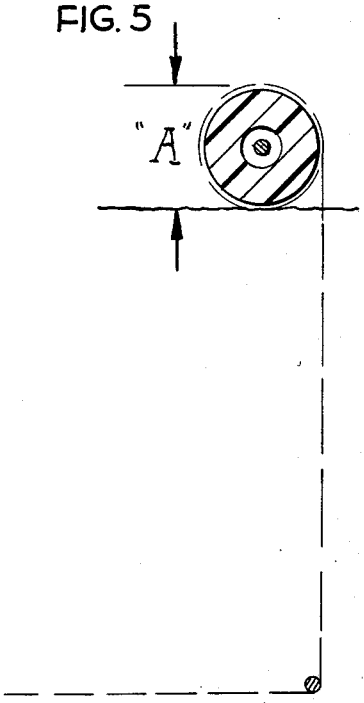
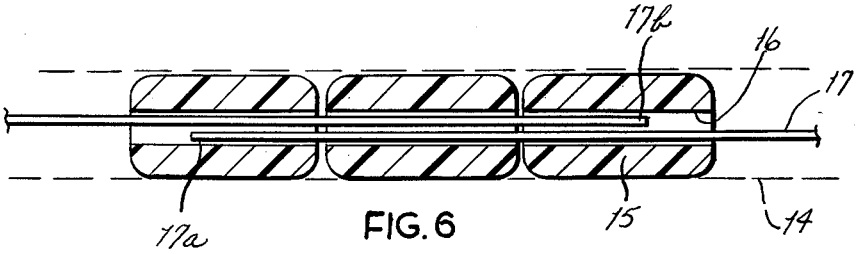
FIG. 6

SELF-OPENING PORTABLE SWIMMING ENCLOSURE AND METHOD OF USING SAME

BACKGROUND OF THE INVENTION

The present invention relates to a swimming enclosure enabling a section of water to be sufficiently separated from the main body of water to permit bathing and swimming at any desired point in open water with protection being provided against jelly fish, including sea nettles, other noxious fish, and voracious aquatic animals.

In certain areas of the Atlantic and Pacific Oceans and other salt water seas, sea nettles are a problem at certain times of the year and cause the water to be practically unusable for swimming, etc. The present invention provides a portable enclosure which can be readily coiled into a compact bundle for storage and which, when placed in the water, is self-opening to provide a floating cylindrically shaped element having side and bottom walls of open mesh material of a size sufficient to repel nettles and the like, and having a lip projecting above the water surface to prevent entry of the creatures into the enclosure through wave action.

There are several devices which purport to provide a swimming enclosure in the open sea but these are either rigid, bulky devices, or otherwise require extensive mechanisms for opening and closing. Among these are those shown in the U.S. Pat. Nos. to Bamber 208,360, Serafinowicz 2,013,635 and 2,092,782, Moray 1,752,191, Limegrover 4,135,256, and Puncochar 3,571,819.

Accordingly, it is a principal object of the present invention to provide a portable swimming enclosure which one person can rapidly remove from the water, coil into a compact bundle and place in a suitable carrying bag for storage. It is a further object to provide a swimming enclosure of this type, which when thrown into the water without restraint, will automatically resume its operating shape without external means. Still another object of the present invention is to provide a light weight swimming enclosure which can be readily taken from a storage condition to an operating condition by one person in a short period of time. These and other objects and advantages will become apparent hereinafter.

The present invention comprises a portable swimming enclosure having a foldable open mesh body defining side and weighted bottom walls, a float system around the open top to provide an upstanding lip above the surface of the water and means for automatically opening the enclosure when it is placed without restraint into the water.

DESCRIPTION OF THE DRAWINGS

In the drawings wherein like numerals refer to like parts wherever they occur:

FIG. 1 is a perspective view showing the protective pool coiled in a storage position within a carrying case;

FIG. 2 is a perspective view showing the protective pool immersed in water and partially uncoiled;

FIG. 3 is a perspective view of the protective pool in the water in a fully uncoiled operating position;

FIG. 4 is a fragmentary sectional view taken along line 4—4 of FIG. 3;

FIG. 5 is a fragmentary sectional view taken along line 5—5 of FIG. 3; and FIG. 6 is a fragmentary sectional view taken along line 6—6 of FIG. 4.

DETAILED DESCRIPTION

The present invention comprises a portable swimming enclosure 10 which includes a cylindrical side wall 11 and a bottom 12 formed of an open mesh material having a hole size of approximately ⅛ of an inch. The mesh can be a polypropylene mesh or other suitable plastic material or fiber cord. The openings in the mesh are sized so as to exclude nettles and other undesirable sea life.

Positioned around the bottom of the side wall 11 where it joins the bottom wall 12 is a series of weights 13 or a continous lead line rope woven into the fiber. This causes the body of the enclosure 10 to sink beneath the surface of the water. At the open or top side of the enclosure 10 is a sleeve 14 into which are positioned a series of floats 15 which may be polyethylene, cork, styrofoam, or other suitable buoyant material.

Formed in the center of each float 15 is a throughbore 16 for freely accommodating a flexible resilient wire rope strand 17. The purpose of the wire rope 17 is to give a form to the enclosure 10 and the ends 17*a* and 17*b* of the wire rope 17 are free and overlapping (FIGS. 4 and 5). The throughbores 16 are sized so that the wire rope 17 is free to rotate and to slide longitudinally through the throughbores 16. The wire rope 17 preferably is made from stainless steel and is a $1\times19$ strand and is 7/32 of an inch in diameter. The stainless steel is to keep the rope 17 from being corroded by the sea water in which it normally is used.

By having the ends 17*a* and 17*b* of the wire rope 17 free to rotate and move longitudinally in the throughbores 16, the enclosure 10 can be coiled into a compact shape for easy storing and carrying (FIG. 1). For convenience, the enclosure 10 is placed into a small netted bag 18 for storage.

The resilient nature of the wire rope 17 causes the enclosure 10 to open itself automatically when it is placed without restraint into the sea (FIG. 2). The weight 13 at the bottom periphery of the enclosure 10 causes it to assume its upstanding form (FIGS. 2 and 3) and the floats 15 provide a lip "A" (FIG. 5) which projects above the water surface to protect the swimmer from nettles and the like being swept into the enclosure by wave action.

A tie line 19 (FIG. 2) is fastened to the enclosure 10 to secure it to a dock or boat while it is in its operating position in the sea.

To use the enclosure 10, it is removed from its carrying bag and merely thrown into the sea where it automatically assumes its open position. This is shown in FIG. 2 and 3. For an enclosure 10 having an eight foot diameter, the circumference of the enclosure 10 is approximately 25 feet and the wire rope 17 is approximately 27 feet in length, thereby providing about a two foot overlap or approximately eight percent overlap. A convenient height of the enclosure 10 from the water line to the bottom wall 12 is approximately 5½ feet. These dimensions can vary as desired.

What is claimed is:

1. A portable swimming enclosure having an erected operating position and a folded coiled storage position comprising:

(a) a foldable open mesh body having side walls and a bottom wall and an open top, (b) weight means positioned at the bottom wall to locate the bottom and side walls beneath the water surface when the enclosure is in its erected position, (c) a float system connected to and extended along the open top of the body to support the enclosure in the water with the open top of its body at the surface of the water, and (d) self-opening resilient means connected with the mesh body at the top thereof for holding the top in an open position when it is in the water so that one may enter the mesh body through its open top, the resilient means also being connected with the float system such that it is supported by the float system at the surface of the water, the resilient means when unrestrained assuming by reason of its resiliency a generally endless configuration that closes upon itself to enclose an area for swimming, the resilient means being capable of folding against its resiliency from the open position to a compact configuration along with the mesh body for storing and carrying.

2. The portable swimming enclosure of claim 1 wherein the self-opening resilient means is formed of stranded wires.

3. The portable swimming enclosure of claim 1 wherein the float system comprises a series of floats having throughbores with the resilient means positioned in the throughbores.

4. The portable swimming enclosure of claim 1 wherein the open mesh body is formed into a closed loop around the top periphery and the float system and resilient means is retained in said closed loop.

5. The portable swimming enclosure of claim 1 wherein the weight means is a lead line woven into the mesh body.

6. The portable swimming enclosure of claim 1 including a tie line fastened to the enclosure for fastening it to a boat or dock.

7. The portable swimming enclosure of claim 1 wherein the float means includes a series of floats positioned around the top of the enclosure and the resilient means is a flexible resilient stranded wire rope in throughbores formed in the floats with the ends of the wire rope being overlapped in a portion of said throughbores and being free to rotate and move longitudinally within said throughbores.

8. The portable swimming enclosure of claim 1 including a carrying case adapted to hold the enclosure when folded and coiled into a compact form.

9. A method of erecting in a large body of water a portable self-contained, self-opening swimming enclosure that is normally stored in a coiled and folded condition in a carrying case and includes an elongated resilient member which when the enclosure is in its carrying case is folded against its own resiliency into a compact configuration, but when unrestrained, self-opens by reason of its resiliency into a generally endless configuration that closed upon itself, a foldable open mesh body connected to the resilient member and having side walls and a bottom wall, weights attached to the mesh body along the bottom wall thereof, and floats attached to the resilient member and having enough bouyancy to support the resilient member, the mesh body and the weights in the water, said method including the steps of removing the coiled folded self-contained, self-opening swimming enclosure from the carrying case, placing the enclosure in partially or completely folded condition in water with its resilient member generally unrestrained, and allowing said resilient member by reason of its own resiliency to assume at the surface of the water the endless configuration that closes upon itself so as to enclose an area in the water and to further allow the mesh body and weights to descend in the water, all without applying significant outside work to the enclosure.

* * * * *